US005642771A

United States Patent [19]

Forest

[11] Patent Number: 5,642,771

[45] Date of Patent: Jul. 1, 1997

[54] PROCESS AND DEVICE FOR MANUFACTURING AT LEAST ONE METAL STRIP OF SMALL WIDTH AND METAL STRIP OBTAINED BY THIS PROCESS

[75] Inventor: Christian Forest, Nevers, France

[73] Assignee: Imphy S.A., Puteaux, France

[21] Appl. No.: 627,753

[22] Filed: Mar. 25, 1996

Related U.S. Application Data

[63] Continuation of Ser. No. 230,840, Apr. 21, 1994, abandoned.

[30] Foreign Application Priority Data

Apr. 28, 1993 [FR] France ..... 93 05042

[51] Int. Cl.[6] ..... B22D 11/06

[52] U.S. Cl. ..... 164/463; 164/423

[58] Field of Search ..... 164/463, 423, 164/429, 479

[56] References Cited

U.S. PATENT DOCUMENTS 4,842,041 6/1989 Sato et al. ..... 164/463

FOREIGN PATENT DOCUMENTS 46-26626 8/1971 Japan ..... 164/479
59-157322 9/1984 Japan ..... 164/463
61-63346 4/1986 Japan ..... 164/479
63-56338 3/1988 Japan ..... 164/463
7140 10/1913 United Kingdom .

OTHER PUBLICATIONS

Patent Abstracts of Japan, vol. 7, No. 102 (M–211) (1247), Apr. 30, 1983, Japanese patent 58–23551, Hiromi Fukuoka, Multislit Nozzle Device for Casting of Amorphous Metal.

Patent Abstracts of Japan, vol. 14, No. 291 (M–989) (4234), Jun. 22, 1990, Japanese Patent 2–92439, Tsuneo Uchino, Method for Directly Casting Wire Rod.

*Primary Examiner*—Kuang Y. Lin

*Attorney, Agent, or Firm*—Oblon, Spivak, McClelland, Maier & Neustadt, P.C.

[57] ABSTRACT

At least one metal strip of small width is manufactured from a molten material held in a metallurgical vessel at a temperature above a melting point of the molten material, by the steps of subjecting the molten material to a pressure at least equal to atmospheric pressure and ejecting the molten material through orifices in a lower part of a nozzle fastened to the vessel and onto a moving cooling surface located beneath the nozzle, the orifices being elongated in the direction of movement of the cooling surface. The molten material is permitted to solidify in grooves in the cooling surface, the grooves being elongated in the direction of movement and facing and being in longitudinal alignment with the orifices.

17 Claims, 3 Drawing Sheets

FIG. 2
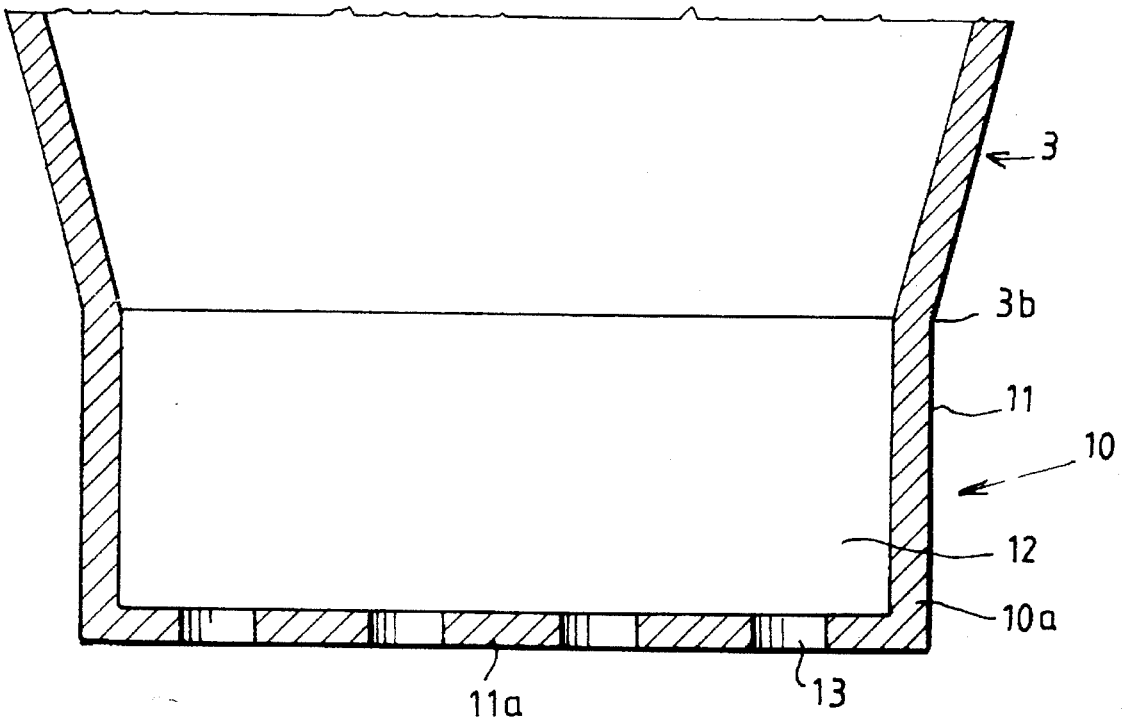
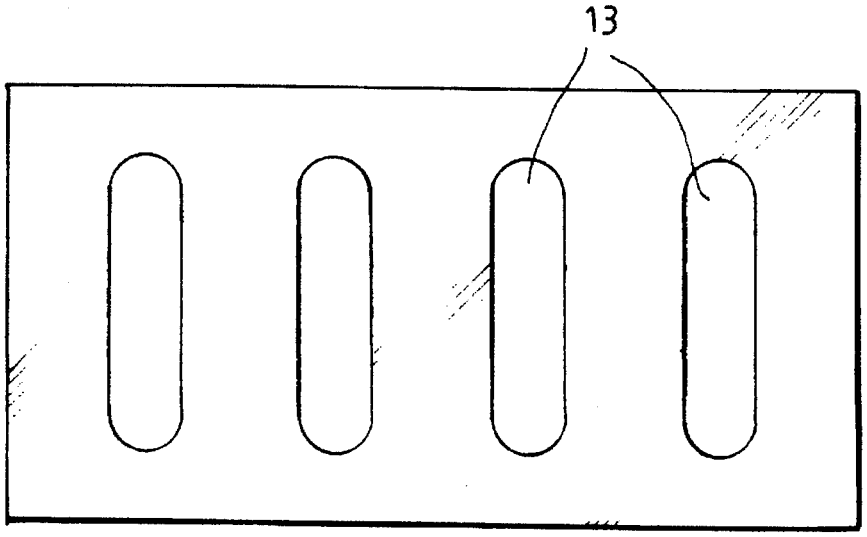
FIG. 3

PROCESS AND DEVICE FOR MANUFACTURING AT LEAST ONE METAL STRIP OF SMALL WIDTH AND METAL STRIP OBTAINED BY THIS PROCESS

This application is a continuation of application Ser. No. 08/230,840, filed on Apr. 21, 1994, now abandoned.

BACKGROUND OF THE INVENTION

The present invention relates to a process and a device for manufacturing at least one metal strip of small width, as well as to a metal strip manufactured by this process.

The subject of the invention is also a nozzle used for the manufacture of this metal strip.

By strip is meant a body of elongate shape, the transverse dimensions of which are very much less than its length. Wires, sheets and metal tapes are, for example, considered as metal strips.

For some technological applications, industrial concerns are obliged to employ metal strips of particular dimensions, and especially require that these strips have a minimum thickness in order to guarantee, for example, their hot oxidation resistance when they are in contact with a highly oxidizing medium as, for example, for metal supports for catalysts.

Among the techniques used hitherto for enabling metal strips to be produced, that which consists in ejecting a molten metal or metal alloy through orifices of circular shape which are made at the lower part of a nozzle with a view to depositing it onto a moving tooling member located beneath the said nozzle, so as to bring about the solidification of this metal or this alloy on the said cooling surface, is especially known.

Such orifices are uniformly arranged at the lower end of the nozzle along a direction transverse with respect to the direction of movement of the surface of the cooling member and face downwards opposite the said cooling surface.

The cooling member is formed, for example, by a wheel.

This technique makes it possible to form, on the cooling surface, metal strips whose small width lies between 0.5 and 1.5 mm and whose thickness is limited to certain values which depend on the widths of these strips.

Thus, an orifice whose diameter is equal to 1 mm makes it possible, for example, to form, on the cooling surface, a metal strip whose width is equal to 1 mm and whose thickness may not exceed 30 μm, which is unacceptable for applications where a minimum thickness of 40 μm is required.

In order to overcome this problem, several, approaches have been envisaged by the Applicant's Company.

First of all, the Applicant's Company has envisaged, in a logical manner, increasing the diameter of the circular orifices of the nozzles so that the thickness of the metal strips is greater.

However, the consequence of this approach was to increase the width of the said strips more than their thickness and the metal products thus obtained were no longer in conformity with the dimensional requirements of the users.

Next, the Applicant's Company envisaged reducing the speed of movement of the cooling member in order to increase the thickness of the metal strip formed.

Now, by decreasing the speed, a loss of adhesion was observed of the metal on the cooling surface, which can lead to a deterioration of the solidification of the metal constituting the metal strip.

For this purpose, tests were carried out by modifying the nature and the roughness of the cooling surface so as to enhance the adhesion of the metal on the said cooling surface.

However, such modifications did not contribute to the enhancement of the adhesion on the surface of the cooling member.

SUMMARY OF THE INVENTION

The purpose of the invention is to overcome these drawbacks by proposing a process and a method for manufacturing at least one metal strip of small width and possessing a greater thickness compared to that of the metal strips obtained by the previously mentioned technique of the prior art.

The subject of the invention is therefore a process for manufacturing at least one metal strip of small width starting from a molten material held at a temperature above its melting point and contained in a metallurgical vessel, according to which process the molten material is injected through a nozzle rigidly fastened to the said metallurgical vessel and the molten material is solidified on a moving cooling surface located beneath the said nozzle, characterized in that:

- the molten material is subjected to a pressure at least equal to the atmospheric pressure;
- the said molten material is ejected through at least one nozzle of elongate shape, made at the lower part of the said nozzle;
- the said molten material is solidified in at least one groove made on the said cooling surface and arranged facing the said orifice and in the alignment of the latter;
- and, simultaneously, the said cooling surface is moved along the longitudinal direction of the said groove.

The subject of the invention is also a device for manufacturing at least one metal strip of small width for the implementation of the process mentioned herein above and comprising:

- a metallurgical vessel containing a molten material held at a temperature above its melting point and including, in its lower part, at least one nozzle communicating with this vessel and being equipped at one of its ends, called the lower end, with at least one orifice for the ejection of a molten material,
- at least one moving tooling surface located beneath the nozzle opposite the said orifice and intended to receive the molten material and to solidify it, characterized in that the metallurgical vessel containing the molten material is at a pressure at least equal to the atmospheric pressure and in that the orifice exhibits a shape which is elongated along the direction of movement of the cooling surface and which is contained in a substantially horizontal plane, the said cooling surface being provided with at least one groove arranged facing the said orifice and in the alignment of the latter.

According to other characteristics of the invention:

- the width of the groove in its top part is greater than the width of the orifice;
- the depth of the groove lies between 1 and 20 times the thickness of the metal strip;
- the groove has a trapezoidal, or V-shaped or semi-circular transverse profile;
- the orifice has an oblong shape;
- the groove is made at the surface of a wheel.

The subject of the invention is also a nozzle for the manufacture of at least one metal strip of small width, formed by a vertical body in which an internal channel is made for the passage of a molten material and including, at one of its ends, the one called the lower end, a plate equipped with at least one orifice for the ejection of the molten material onto a moving cooling surface, characterized in that the said orifice has a shape which is elongated along the direction of movement of the said cooling surface and which is contained in a substantially horizontal plane.

The subject of the invention is also a metal strip of small width obtained by the process mentioned herein above, characterized in that the said metal strip has a width less than or equal to 2 mm.

According to a preferential characteristic, the metal strip has a thickness greater than or equal to 30 μm.

BRIEF DESCRIPTION OF THE DRAWINGS

Other characteristics and advantages will appear in the course of the description which will follow, given solely by way of example and given with reference to the appended drawings, in which:

FIG. 2 is a view, in longitudinal section, of the nozzle of the device according to the invention;

FIG. 3 is a view from below of the nozzle of the device according to the invention;

DETAILED DESCRIPTION OF THE PREFERRED EMBODIMENTS

Figure 1:
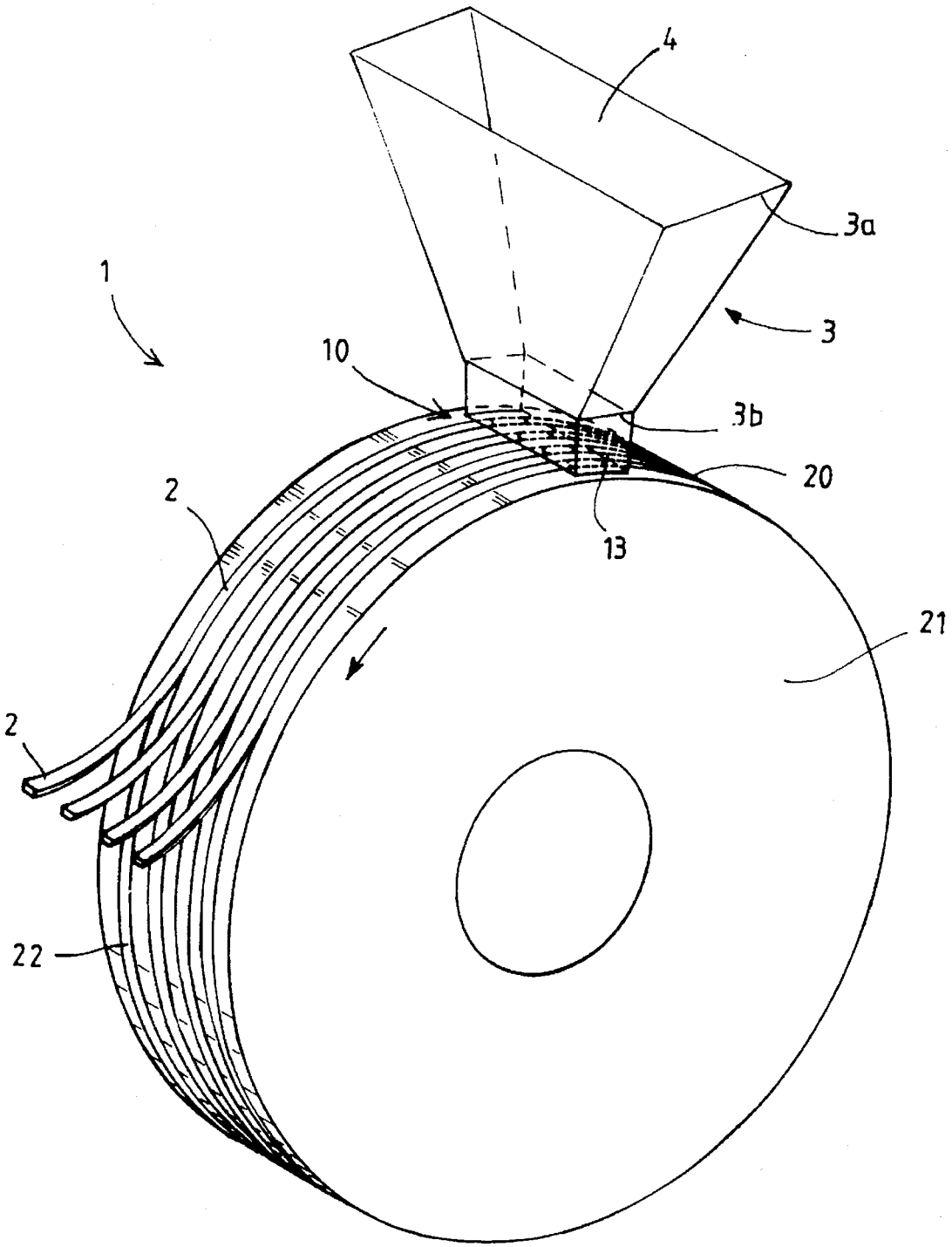
FIG. 1 is a diagrammatic view, in perspective, of the device for manufacturing at least one metal strip according to one embodiment of the invention.

As shown in FIG. 1, the device designated in its entirety by the reference 1 is intended for the manufacture of at least one metal strip 2 of small width and comprises a metallurgical vessel 3, called a distributor, containing a molten material 4.

The metallurgical vessel 3 has, for example, a general shape which is flared upwards at 3*a* and its cross-section is rectangular.

The molten material 4 contained in the metallurgical vessel 3 is held at a temperature above its melting point by means, for example, of a conventional induction coil, not shown, arranged around the said vessel 3 and overs its entire height.

The molten material is formed, for example, by a metal alloy of the following composition by weight: 15 to 25% chromium, 4 to 10% aluminium, and the balance being constituted by iron and, possibly, rare earths or elements similar to the rare earths.

The metallurgical vessel 3 includes, in its restricted lower part 3*b*, a nozzle 10 connected to the said vessel 3 and rigidly fastened to the latter by conventional means, not shown.

For this purpose, the nozzle 10 is, for example, equipped on its external upper face with a thread corresponding to a thread located on the internal wall of a conduit constructed in the bottom of the vessel 3, thus enabling it to be fixed by screwing.

As shown in FIG. 2, the nozzle 10 is formed by a vertical body 11 in which is made an internal channel 12 communicating with the metallurgical vessel 3 and enabling the molten metal 4 to flow out towards one of the ends 10*a*, called the lower end, of the nozzle 10.

The vertical body 11 is equipped, at its lower part, with a horizontal plate 11*a* perpendicular to the side walls of the vertical body 11 and including at least one orifice 13.

As shown in FIG. 1, the device 1 according to the invention also comprises at least one moving cooling surface 20 located beneath the nozzle 10 and facing the orifice 13.

This cooling surface 20, formed, for example, by the surface of a wheel 21, is provided with at least one groove 22 arranged facing the orifice 13 and in the alignment of the latter.

The orifice 13 has a shape which is elongated along the direction of movement of the cooling surface 20 and which is contained in a substantially horizontal plane.

The function of the orifice 13 is to enable the molten material 4 to be ejected towards the cooling surface 20, and its shape promotes the ejection of the said molten material into the groove 22 placed facing the said orifice 13, in which it solidifies, thereby forming the metal strip 2.

In order to ensure ejection of the molten material via the orifice 13, this molten material is subjected to a sufficiently high pressure by bringing the metallurgical vessel 3 into communication with the atmospheric pressure and by using a sufficient height of molten material in the said metallurgical vessel 3.

It is also possible, when the pressure due to the height of molten material 4 contained in the metallurgical vessel 3 is too low, to make use of a pressurized gas above the upper level of the said molten material 4.

As shown in FIGS. 2 and 3, the plate 11*a* of the vertical body 11 is equipped with four identical orifices 13 which are parallel to each other and uniformly spaced by a distance substantially greater than the largest width of each orifice 13 and, for example, equal to 1.5 times the largest width of the orifice.

That being so, the cooling surface 20 of the wheel 21 includes four grooves 22 each arranged facing an orifice 13 of the nozzle 10 and parallel to each other.

The respective dimensions of the grooves 22 and of the orifices 13 are Judiciously chosen in order to obtain metal strips 2 of a given width, whose thickness is increased compared to that of metal strips obtained in a conventional manner by the casting of molten metal onto a cooling surface through orifices of circular shape.

The Applicant's Company has also found that the use of a nozzle having orifices of elongated shape in order to eject a molten material onto a smooth cooling surface is not satisfactory, given that the width of the strips thus formed is increased more than their thickness.

For this, the width of each groove 22 in its top part 22*a* is greater than the largest width of each orifice 13.

Preferably, the width of each groove 22 in its top part 22*a* lies between 1.5 and 5 times the greatest width of each orifice 13 and is, for example, equal to 1.75 times the greatest width of each orifice.

Depending on the shape which it is desired to obtain for the metal strips 2, it is possible to give the bottom part 22*b* of each groove 22 an adapted shape.

The depth of each groove 22 lies between one and twenty times the thickness of the strip 2, preferably lying between one and ten times this thickness and more preferentially lying between one and five times the thickness of the metal strip 2.

For example, the depth of each groove 22 is equal to 4.5 times the intended thickness of the metal strip.

Figure 4:
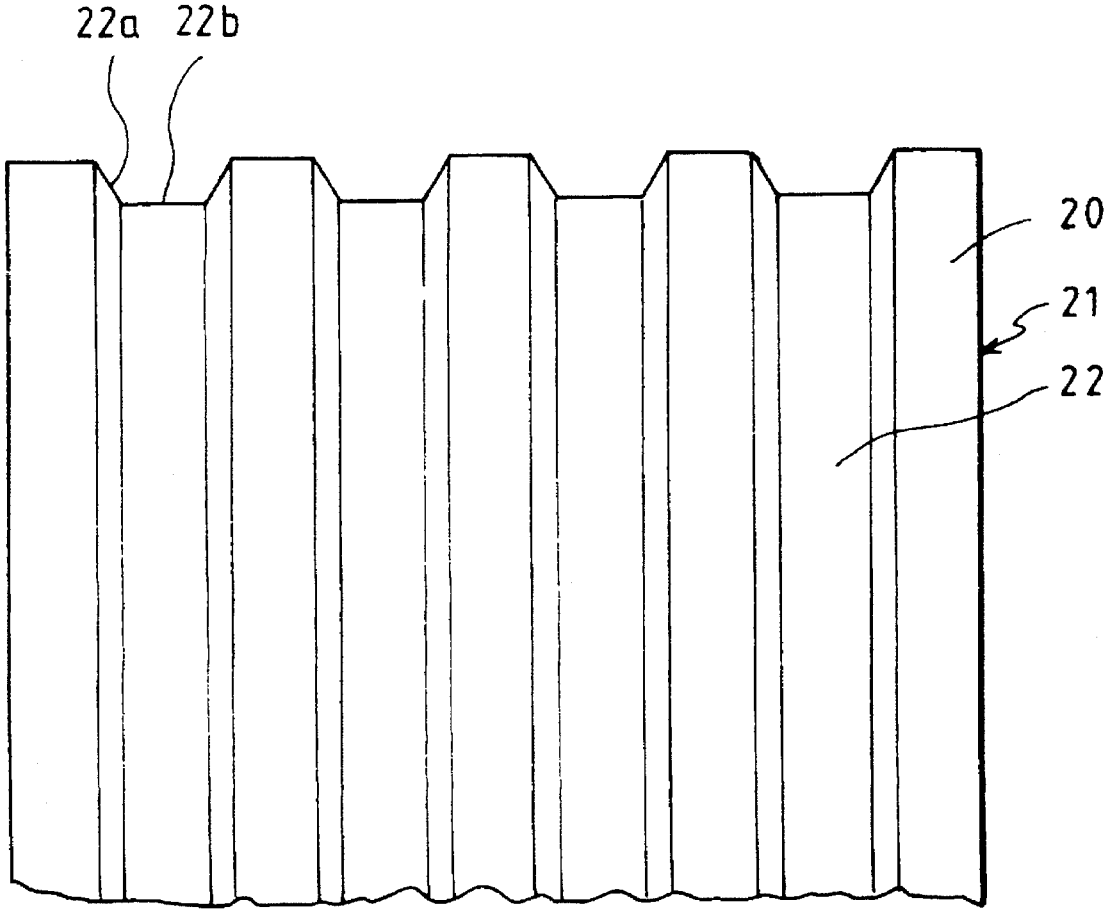
FIG. 4 is a diagrammatic partial view, from above, of the cooling member of the device according to the invention.

As shown in FIG. 4, each groove 22 has a trapezoidal tranverse profile, but this shape is in no way limiting, and V- or semi-circular-shaped transverse profiles may be envisaged.

Each orifice 13 is located at a distance from the cooling surface 20 lying between 0.1 and 2 mm, preferably lying between 0.1 and 1 mm and, for example, equal to 0.5 mm.

According to a preferential embodiment shown in FIG. 3, each orifice 13 has an oblong shape, but it may also cover various elongated shapes depending on the geometry desired for the metal strips 2.

The length of each orifice 13 is less than 6 mm, preferably less than 3 mm and, for example, equal to 2.8 mm.

The linear speed of movement of the cooling surface 20 lies between 10 and 60 m/s and, preferably, lies between 30 and 45 m/s.

The metal strips 2 manufactured by the process according to the invention have a width less than or equal to 2 mm and a thickness greater than or equal to 30 μm.

In a groove of 0.2 mm depth, of 1.4 mm width in the top part and of 1.2 mm width in the bottom part, metal strips are manufactured with a width of 1.2 mm and a thickness of 45 μm by using a nozzle having an oblong orifice of 2.8 mm in length and of 0.8 mm in width, for a linear speed of movement of the cooling surface of from 20 to 40 m/s.

According to the prior art, a nozzle having a circular orifice whose diameter is equal to 1.1 mm would have enabled a metal strip of 1.2 mm in width and of 30 μm in thickness to be obtained.

I claim:

1. A process of manufacturing at least one metal strip of small width from a molten material held in a metallurgical vessel at a temperature above a melting point of said molten material, comprising the steps of:

subjecting the molten material to a pressure at least equal to atmospheric pressure;

ejecting the molten material through at least one orifice in a lower part of a nozzle fastened to said vessel and onto a moving cooling surface located beneath said nozzle, said at least one orifice being elongated in the direction of movement of said cooling surface;

providing at least one groove in said cooling surface, wherein a width of a top of said at least one groove is between 1.5 and 5 times a maximum width of said at least one orifice;

permitting said molten material to solidify in said at least one groove in said cooling surface, said at least one groove being elongated in said direction of movement, said at least one groove facing and being in longitudinal alignment with said at least one orifice.

2. The process of claim 1 wherein said cooling surface is moving at a linear speed of between 10 and 60 meters/sec.

3. The process of claim 1 wherein said cooling surface is moving at a linear speed of between 30 and 45 meters/sec.

4. The process of claim 1, wherein the at least one metal strip has a width no greater than about 2 mm.

5. An apparatus for manufacturing at least one metal strip of small width by ejecting molten metal, comprising:

a metallurgical vessel containing a molten material at a temperature above a melting point of said molten material;

a nozzle connected to a lower part of said metallurgical vessel, said nozzle having at least one orifice for ejection of the molten material; and a moving cooling surface located beneath said nozzle and facing said at least one orifice, said cooling surface having at least one elongated groove in alignment with said at least one orifice for receiving the ejected molten material so that the ejected molten material can solidify thereon, said at least one orifice being elongated in the direction of movement of said cooling surface, said at least one groove being in longitudinal alignment with said at least one orifice wherein a width of a top of said at least one groove is between 1.5 and 5 times a maximum width of said at least one orifice.

6. The apparatus of claim 5 wherein a depth of said at least one groove is between 1 and 20 times a thickness of the metal strip to be produced.

7. The apparatus of claim 5 wherein a depth of said at least one groove is between 1 and 10 times a thickness of the metal strip to be produced.

8. The apparatus of claim 5 wherein a depth of said at least one groove is between 1 and 5 times a thickness of the metal strip to be produced.

9. The apparatus of claim 5 wherein said at least one groove has a trapezoidal transverse profile.

10. The apparatus of claim 5 wherein said at least one groove has a V-shaped transverse profile.

11. The apparatus of claim 5 wherein said at least one groove has a semi-circular transverse profile.

12. The apparatus of claim 5 wherein said cooling surface receiving the ejected molten material is spaced from said at least one orifice by between 0.1 and 2 mm.

13. The apparatus of claim 5 wherein said cooling surface receiving the ejected molten material is spaced from said at least one orifice by between 0.1 and 1 mm.

14. The apparatus of claim 5 wherein a length of said at least one orifice in the direction of elongation is less than 6 mm.

15. The apparatus of claim 5 wherein a length of said at least one orifice in the direction of elongation is less than 3 mm.

16. The apparatus of claim 5 wherein said at least one orifice has an oblong shape.

17. The apparatus of claim 5 wherein said cooling surface is the peripheral surface of a wheel.

* * * * *